US011078770B2

(12) United States Patent
Alruwaili et al.

(10) Patent No.: US 11,078,770 B2
(45) Date of Patent: Aug. 3, 2021

(54) STIMULATING U-SHAPE WELLBORES

(71) Applicant: Saudi Arabian Oil Company, Dhahran (SA)

(72) Inventors: Khalid Mohammed M. Alruwaili, Dhahran (SA); Mohamed Nabil Noui-Mehidi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/676,890

(22) Filed: Nov. 7, 2019

(65) Prior Publication Data

US 2020/0256174 A1 Aug. 13, 2020

Related U.S. Application Data

(63) Continuation of application No. 16/272,699, filed on Feb. 11, 2019, now Pat. No. 10,612,355.

(51) Int. Cl.

| | |
|---|---|
| ***E21B 43/26*** | (2006.01) |
| ***E21B 33/124*** | (2006.01) |
| ***E21B 33/13*** | (2006.01) |
| ***E21B 43/29*** | (2006.01) |
| ***E21B 49/00*** | (2006.01) |

(52) U.S. Cl.

CPC ..... *E21B 43/26* (2013.01); *E21B 33/124* (2013.01); *E21B 33/13* (2013.01); *E21B 49/006* (2013.01)

(58) Field of Classification Search

None

See application file for complete search history.

(56) References Cited

U.S. PATENT DOCUMENTS

| | | | |
|---|---|---|---|
| 2,699,212 | A | 1/1955 | Dismukes |
| 3,254,720 | A | 8/1966 | Huitt |
| 4,683,950 | A | 8/1987 | Lessi |

(Continued)

FOREIGN PATENT DOCUMENTS

WO WO 2018175394 9/2018

OTHER PUBLICATIONS

International Search Report and Written Opinion issued in International Application No. PCT/US2020/107610 dated May 8, 2020, 13 pages.

(Continued)

*Primary Examiner* — Matthew Troutman
*Assistant Examiner* — Douglas S Wood
(74) *Attorney, Agent, or Firm* — Fish & Richardson P.C.

(57) ABSTRACT

A cylindrical drum with a fluid inlet is configured to be connected to a downhole end of a fluid conduit. The cylindrical drum has an outer surface along which is the fluid inlet. The cylindrical drum has a center and an inner surface. Fluid nozzles fluidically connect to an interior of the cylindrical drum and are positioned around the outer circumference of the cylindrical drum. The fluid nozzles are positioned to direct fluid away from the cylindrical drum. A rotatable collar is positioned in the center of the cylindrical drum. The rotatable collar has an outer surface parallel to the inner surface of the cylindrical drum. Sleeve plates are positioned between the inner surface of the cylindrical drum and the outer surface of the rotatable collar. Each of the sleeve plates defines a hole with a diameter smaller than a diameter of a corresponding dropped ball.

9 Claims, 8 Drawing Sheets

(56) References Cited

U.S. PATENT DOCUMENTS

| | | | | |
|---|---|---|---|---|
| 4,687,061 | A | 8/1987 | Uhri | |
| 6,119,776 | A | 9/2000 | Graham et al. | |
| 8,631,872 | B2 | 1/2014 | East | |
| 10,612,355 | B1 | 4/2020 | Alruwaili et al. | |
| 2008/0264640 | A1 | 10/2008 | Eslinger | |
| 2011/0284214 | A1 | 11/2011 | Ayoub et al. | |
| 2016/0201440 | A1 | 7/2016 | Aidagulov | |
| 2018/0266183 | A1* | 9/2018 | Ayub | E21B 43/26 |
| 2018/0334903 | A1* | 11/2018 | Lehr | E21B 47/06 |
| 2020/0024935 | A1 | 1/2020 | Eitschberger et al. | |
| 2020/0024936 | A1* | 1/2020 | Chang | E21B 23/06 |

OTHER PUBLICATIONS

Al-Qahtani et al., "A Semi-Analytical Model for Extended-Reach Wells with Wellbore Flow Splitting; a Production Optimization Scheme," SPE-177931, presented at the Abu Dhabi International Petroleum Exhibition and Conference, Nov. 9-12, 2015, 21 pages.

Shi et al., "Research and Application of Drilling Technology of Extended-reach Horizontally-intersected Well Used to Extract Coalbed Methane," 2011 Xi'An International Conference on Fine Geological Exploration and Groundwater & Gas Hazards Control in Coal Mines, Procedia Earth and Panetary Science vol. 3, Dec. 2011, 9 pages.

Xi et al., "Uncertainty Analysis Method for Intersecting Process of U-Shaped Horizontal Wells," Arabian Journal for Science and Engineering, vol. 40, Issue 2, Feb. 2015, 12 pages.

International Search Report and Written Opinion issued in International Application No. PCT/US2020/017608 dated May 15, 2020, 14 pages.

* cited by examiner

STIMULATING U-SHAPE WELLBORES

CLAIM OF PRIORITY

This application claims priority to and is a continuation of U.S. patent application Ser. No. 16/272,699, filed on Feb. 11, 2019, the entire contents of which is hereby incorporated by reference.

TECHNICAL FIELD

This disclosure describes technologies relating to stimulating U-shaped wellbores.

BACKGROUND

U-shaped wellbores include two vertical wellbores intersecting a horizontal wellbore. The horizontal wellbore, having both a vertical section and a horizontal section, is drilled, and then the vertical wellbore is drilled to intersect with the downhole end, also referred to as the "toe" of the horizontal wellbore. U-shaped wellbores can be useful for increasing production rates because two topside facilities can both produce from the horizontal wellbore.

In hydrocarbon production, wellbores are often fractured by pumping high-pressure fluids via a wellbore into a zone of interest. A zone of interested is typically a section of a geologic formation that has a great probability of producing hydrocarbons. The high-pressure fluid has sufficient pressure to exceed the yield-strength of the rock in the geologic formation, causing fracture propagation. The fractures increase a flow area from the geologic formation into the wellbore.

SUMMARY

This disclosure describes technologies relating to stimulating U-shaped wellbores.

An example implementation of the subject matter described within this disclosure is a downhole-type wellbore notching tool with the following features. A cylindrical drum with a fluid inlet is configured to be connected to a downhole end of a fluid conduit. The cylindrical drum has an outer surface along which is the fluid inlet. The cylindrical drum has a center and an inner surface. Fluid nozzles fluidically connect to an interior of the cylindrical drum and are positioned around the outer circumference of the cylindrical drum. The fluid nozzles are positioned to direct fluid away from the cylindrical drum. A rotatable collar is positioned in the center of the cylindrical drum. The rotatable collar has an outer surface parallel to the inner surface of the cylindrical drum. Sleeve plates are positioned between the inner surface of the cylindrical drum and the outer surface of the rotatable collar. Each of the sleeve plates defines a hole with a diameter smaller than a diameter of a corresponding dropped ball.

Aspects of the example implementation, which can be combined with the example implementation alone or in combination, include the following. A first sleeve plate has a first hole with a first diameter smaller than a first dropped ball of a first size. A second sleeve plate has a second hole with a second diameter smaller than a second dropped ball of a second size.

Aspects of the example implementation, which can be combined with the example implementation alone or in combination, include the following. Each of the sleeve plates is configured to rotate around the rotatable collar when a dropped ball is received. Each rotated sleeve of the plurality of sleeve plates is configured to direct fluid towards a respective nozzle in response to the rotation.

Aspects of the example implementation, which can be combined with the example implementation alone or in combination, include the following. The dropped ball is a dissolvable dropped ball. The dissolvable dropped ball is configured to dissolve at a specified time within a notching fluid.

An example implementation of the subject matter described within this disclosure is a method with the following features. A notching tool is positioned within a wellbore at a distal end of a fluid string. A ball is dropped through the fluid string toward the notching tool. The dropped ball is sized to trigger a specified notching angle. The dropped ball is received by the notching tool. A notch is formed at the specified notching angle.

Aspects of the example implementation, which can be combined with the example implementation alone or in combination, include the following. An angle of the least principle stress within the wellbore is determined.

Aspects of the example implementation, which can be combined with the example implementation alone or in combination, include the following. The specified notching angle is perpendicular to the least principal stress of the wellbore.

Aspects of the example implementation, which can be combined with the example implementation alone or in combination, include the following. Receiving the dropped ball by the notching tool includes receiving the dropped ball by a sleeve plate within the notching tool. The sleeve plate has a hole with a smaller diameter than the received dropped ball.

Aspects of the example implementation, which can be combined with the example implementation alone or in combination, include the following. The dropped ball is a dissolvable dropped ball configured to dissolve after a pre-determined period of time.

Aspects of the example implementation, which can be combined with the example implementation alone or in combination, include the following. Forming the notch includes actuating the sleeve plate in response to receiving the dropped ball. Fluid is directed through a nozzle that corresponds to the actuated sleeve plate.

Aspects of the example implementation, which can be combined with the example implementation alone or in combination, include the following. The notching tool is removed from the wellbore. A fracturing fluid is pumped through the wellbore toward the notch.

Aspects of the example implementation, which can be combined with the example implementation alone or in combination, include the following. The wellbore is a U-shaped wellbore with a first end, a second end, and a horizontal wellbore section.

Aspects of the example implementation, which can be combined with the example implementation alone or in combination, include the following. Pumping the fracturing fluid includes pumping fracturing fluid from a first end of the wellbore and pumping fracturing fluid from a second end of the wellbore.

An example implementation of the subject matter described within this disclosure is a wellbore notching system with the following features. A fluid conduit extends from a topside facility into a wellbore. A well-notching tool is fluidically connected to and positioned at a downhole end of the fluid conduit within a wellbore. The well-notching tool includes a cylindrical drum with a fluid inlet fluidically connected to the downhole end of a fluid conduit. The cylindrical drum has an outer surface along which is the fluid inlet. The cylindrical drum has an inner surface and a center. Fluid nozzles fluidically connect to an interior of the cylindrical drum and are positioned around the outer circumference of the cylindrical drum. The fluid nozzles are positioned to direct fluid away from the cylindrical drum. A rotatable collar is positioned in the center of the cylindrical drum. The rotatable collar has an outer surface parallel to the inner surface of the cylindrical drum. Sleeve plates are positioned between the inner surface of the cylindrical drum and the outer surface of the rotatable collar. Each of the sleeve plates defines a hole with a diameter smaller than a diameter of a corresponding dropped ball. An isolation packer is positioned uphole of the well-notching tool. The isolation packer fluidically isolates a section of the wellbore to be notched from a remainder of the wellbore.

Aspects of the example implementation, which can be combined with the example implementation alone or in combination, include the following. The wellbore is a U-shaped wellbore with a first end and a second end. The topside facility is a first topside facility located at a first end of the U-shaped wellbore. The fluid conduit is a first fluid conduit extending from the first topside facility. The well-notching tool is a first well-notching tool. The isolation packer is a first isolation packer. A second fluid conduit extends from a second topside facility positioned at a second end of the wellbore. A second well-notching tool, identical to the first well-notching tool, is fluidically connected to a downhole end of the second fluid conduit within the U-shaped wellbore. A second isolation packer is positioned uphole of the second well-notching tool. The isolation packer fluidically isolates the section of the wellbore to be notched from a remainder of the wellbore toward the second topside facility.

Aspects of the example implementation, which can be combined with the example implementation alone or in combination, include the following. A first sleeve plate has a first hole sized to receive a first dropped ball of a first size. A second sleeve plate has a second hole sized to receive a second dropped ball of a second size.

Aspects of the example implementation, which can be combined with the example implementation alone or in combination, include the following. Each of the sleeve plates is configured to rotate around the rotatable collar when a dropped ball of a sufficient diameter is received. Each rotated sleeve plate is configured to direct fluid towards a respective nozzle in response to the rotation.

Aspects of the example implementation, which can be combined with the example implementation alone or in combination, include the following. The dropped ball is a dissolvable dropped ball. The dissolvable dropped ball is configured to dissolve at a specified time within a notching fluid.

Particular implementations of the subject matter described in this disclosure can be implemented so as to realize one or more of the following advantages. Notching parallel to the least principle stress results in a better fracturing job and higher production rates. Stimulation from both sides allows for a smaller footprint at each site for stimulation infrastructure. Multiple production zones can be targeted within a horizontal wellbore. Certain reservoir topologies described herein can have a majority of equipment stay at a single site, reducing logistical issues.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

This disclosure relates to a method of fracturing a tight (low permeability) geologic reservoir with a U-shaped well, but can also be used for similar hydrocarbon bearing formations. A first wellbore with a vertical section and a horizontal section is drilled from a first location. The first wellbore has a first end at a terranian surface and a second end at a downhole, or distal end, opposite the first end. A second, vertical well is drilled at a second location and intersects with the toe (distal end) of the first wellbore to form the U-shaped wellbore. The horizontal section of the "U" is divided into one or more compartments by retrievable mechanical packers. Fluid pressure is varied from each location depending on the horizontal location of the intended fracture. Fracturing fluid is pumped into the wellbore from topside facilities at both locations (the tops of the "U") to provide the fluid pressure. The various packers used to isolate the horizontal section of the wellbore are configured to receive flow from both directions, and direct the flow into the formation from the wellbore to initiate a fracture.

Alternatively or in addition, multiple horizontal wells can extend from a central vertical wellbore in a spoke-like patter. This implementation enables multiple horizontal sections to be fracked from the central vertical wellbore. Prior to fracturing, either implementation can horizontal wellbores can be notched to assist in fracturing at specified locations.

Figure 1A:
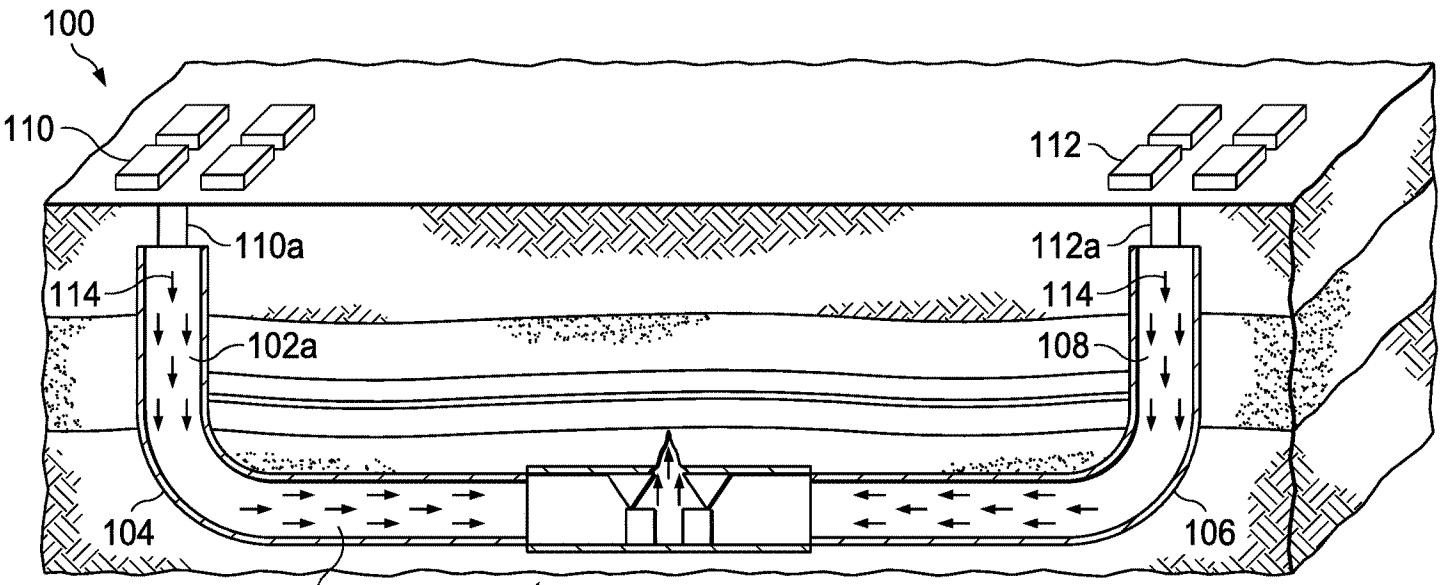
FIG. 1A is a schematic diagram of a U-shaped wellbore during fracturing operations.

FIG. 1A is a schematic diagram of a U-shaped wellbore 100 during fracturing operations. The U-shaped wellbore 100 is formed by drilling a first horizontal wellbore 102. The first horizontal wellbore 102 includes a vertical section 102*a* and a horizontal section 102*b*. The transition between the vertical section 102*a* and the horizontal section 102*b* is referred to as a heel 104. The heel 104 is illustrated as a hard 90° turn, but it can also be a gradual transition between the vertical section 102*a* and the horizontal section 102*b* without departing from this disclosure. The distal, or downhole, end of the first horizontal wellbore 102 is referred to as a toe 106. A second wellbore 108 having a vertical section is drilled into the toe 106 to complete the U-shaped wellbore 100. While illustrated as a straight, vertical wellbore, the second wellbore 108 can be slightly deviated without departing from this disclosure. In general, the U-shaped wellbore 100 includes a horizontal section 102*b*, a first wellbore opening, and a second wellbore opening. A first topside facility 110 can be attached to or be otherwise fluidically coupled to the first wellbore opening, and a second topside facility 112 can be attached to or be otherwise fluidically connected to the second wellbore opening.

The first topside facility 110 and the second topside facility 112 can include fracturing equipment such as manifolds, pumps, mixers, storage tanks, derricks, and other necessary support equipment for fracturing operations. During fracturing operations, fracturing fluid 114 is pumped from the first topside facility 110 and the second topside facility 112 simultaneously towards a fracturing point 116. The fracturing fluid pressure at the first topside facility 110 and the second topside facility 112 are such that the fracturing fluid from both locations is substantially the same pressure once the fluids reach the fracturing point 116. In general, the maximum allowable pressure is governed by the type of completion. For example, the wellbore completion may have a maximum pressure rating of up to 20,000 pounds per square inch (psi) but due to safety factors at the topside facilities, the allowable maximum pressure may reach up to 13,000 psi to 16,000 psi per well. Pumping fracturing fluid 114 from the first topside facility 110 and the second topside facility 112 simultaneously allows for greater flowrates and pressures at the fracture point 116 while maintaining a smaller physical surface footprint at each location.

In some implementations, the first topside facility 110 and the second topside facility 112 each pump a fracturing fluid 114 that is substantially identical within typical mixing tolerances. In some implementations, the first topside facility 110 and the second topside facility 112 each pump a fracturing fluid 114 that are different from one another. For example, fracturing fluid from the first topside facility 110 may include lubricants to reduce the pressure drop to the fracture point 116 if there is a difference in tubing diameter, tubing roughness, or tubing length between the first topside facility 110 and the fracture point 116 in comparison to the second topside facility 112. In some implementations, the fracture point 116 is substantially (within +/−10%) halfway through a length of the horizontal section 102*b* within typical measurement errors. In some implementations, the pressure of the fracturing fluid at the first topside facility 110 and the second topside facility 112 is substantially identical within standard pressure measurement errors.

Figure 1B:
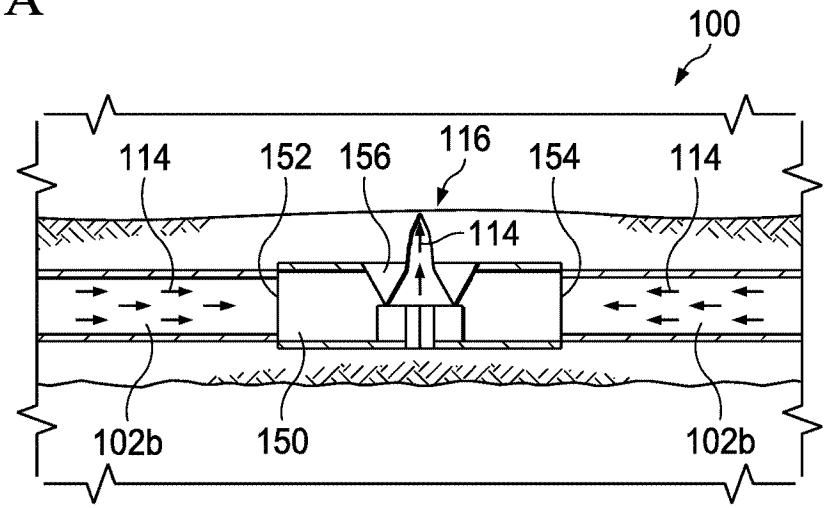
FIG. 1B is a schematic diagram of a fracturing point within the U-shaped wellbore.

FIG. 1B is a schematic diagram of a fracturing point 116 within the U-shaped wellbore 100. At the fracture point 116 within the horizontal section 102*b* of the wellbore 100, a fracture packer 150 is positioned adjacent to the fracture point 116. The fracture packer 150 includes a first fluid inlet 152 and a second fluid inlet 154. The first fluid inlet 152 receives fracturing fluid 114 from the first topside facility 110, while the second fluid inlet 154 receives fracturing fluid 114 from the second topside facility 112. The fracturing packer 150 then directs the fracturing fluid from both topside facilities out a fracturing nozzle 156 into the geologic formation, fracturing the formation. In some implementations, the fracture point 116 can be notched prior to fracturing to improve fracture propagation. Details with such implementations are described later within this disclosure.

Figure 2:
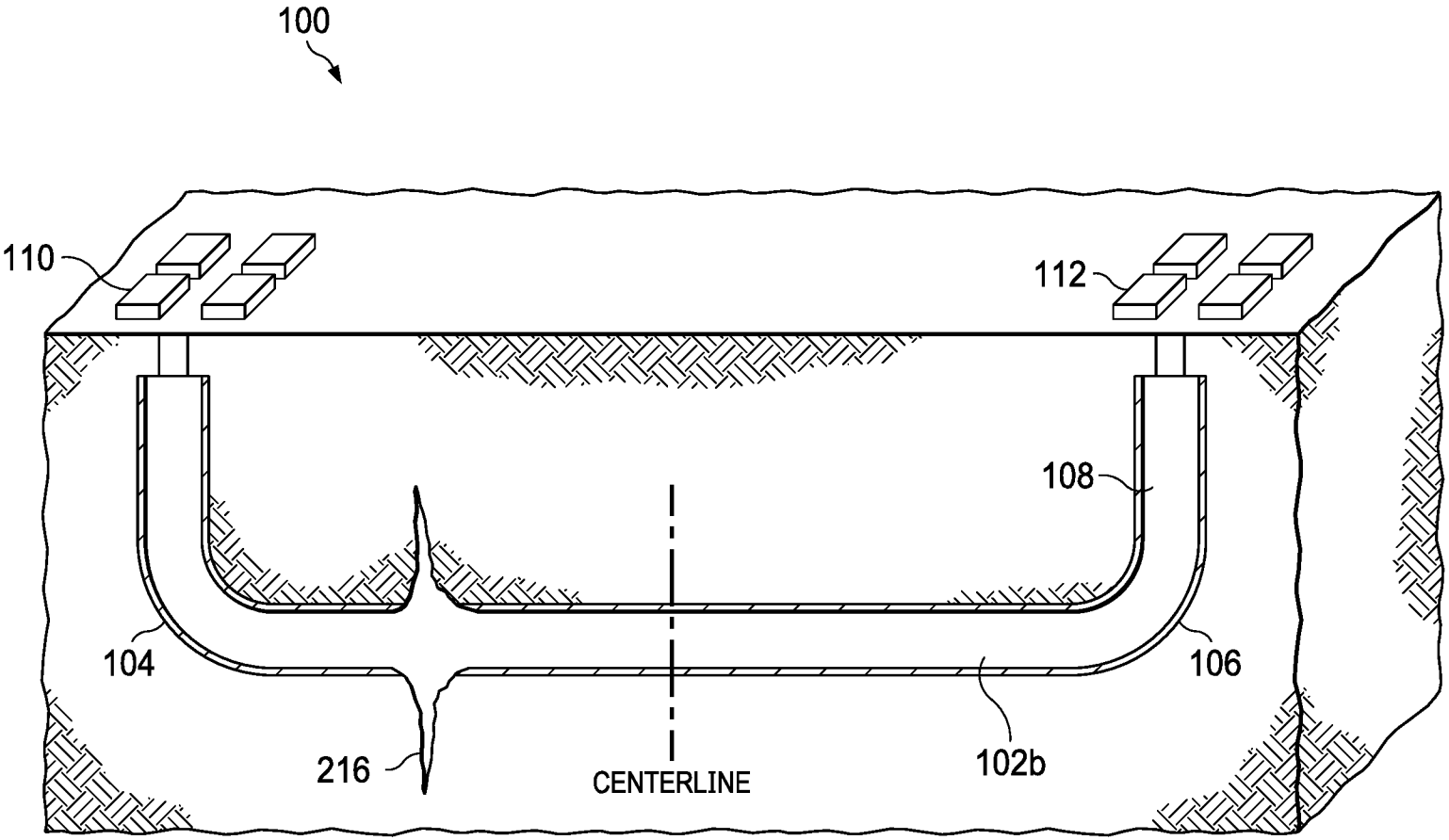
FIG. 2 is a schematic diagram of a U-shaped wellbore with a fracturing point that is offset from the middle of the horizontal section.

FIG. 2 is a schematic diagram of the U-shaped wellbore 100 with a fracturing point 216 that is substantially offset from the middle of the horizontal section 102*b* (more than +/−10% from the halfway point). In such implementations, the first pressure and the second pressure result in the first fracturing fluid from the first topside facility 110 and the second fracturing fluid from the second topside facility 112 intersecting at the fracture point 216 within the horizontal section 102*b* at a third pressure. The first fracturing fluid and the second fracturing fluid experience a first pressure drop and a second pressure drop, respectively, while traveling through their respective wellbores to the fracture point 216. As the distance traveled from each topside facility is different, the first pressure drop and the second pressure drop can be different as well. To compensate for this, the first pressure at the first topside facility is different from the second pressure at the second topside facility. For example, if the fracturing point 216 is closer to the first topside facility, the fracture fluid at the first topside facility may not be at as great a pressure as the fracture fluid at the second topside facility.

Figure 3:
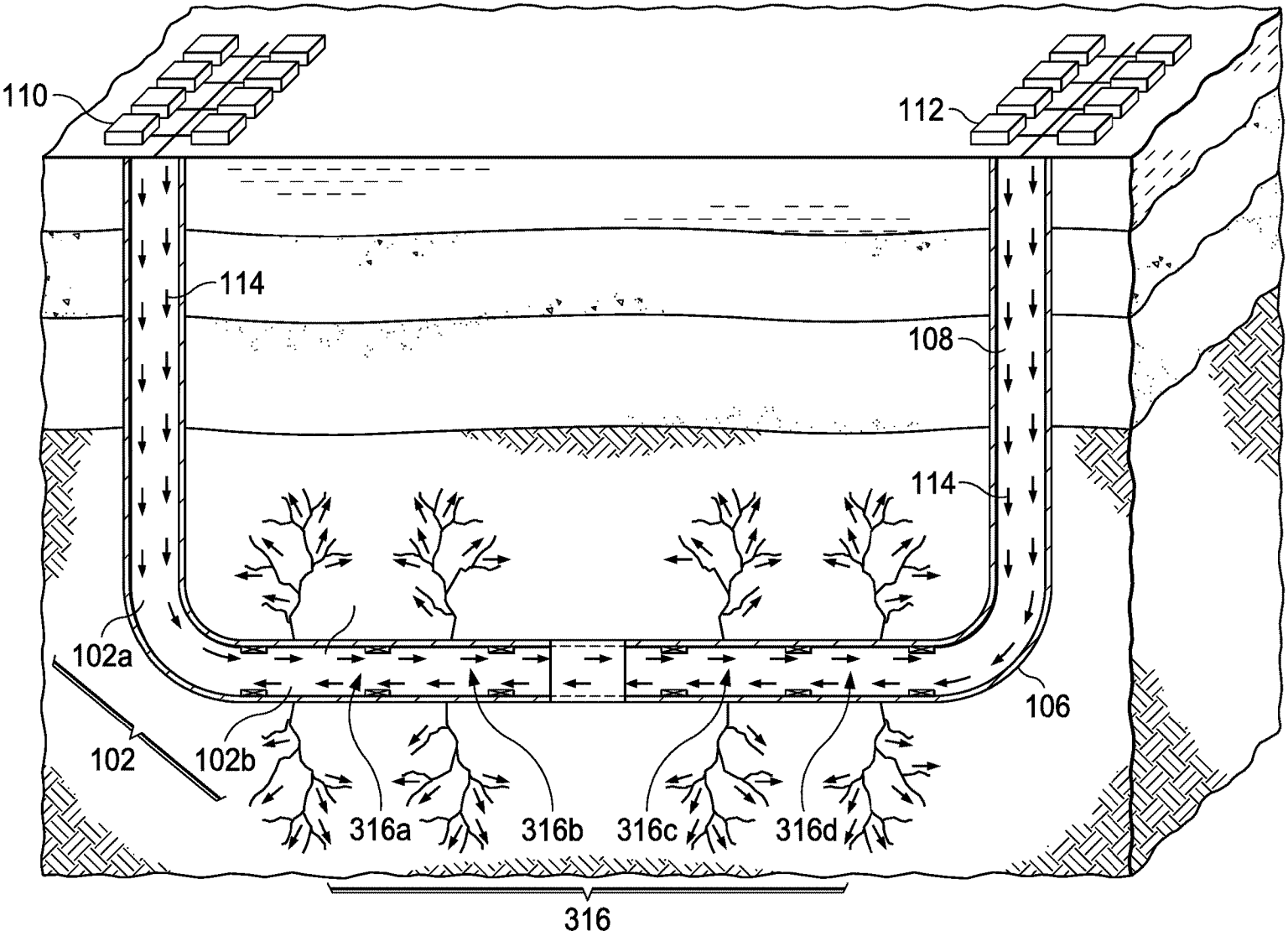
FIG. 3 is a schematic diagram of a U-shaped wellbore with multiple fracturing points.

FIG. 3 is a schematic diagram of the U-shaped wellbore 100 with multiple fracturing points 316. A first fracture point 316*a*, a second fracture point 316*b*, a third fracture point 316*c*, and a fourth fracture point 316*d* are all located within the horizontal section 102*b*. While illustrated with four fracture points within the horizontal section 102*b*, more or less fracture points can be used. Alternatively or in addition, fracture points can exist in the first vertical section 102*a* or the second vertical wellbore 108 without departing from this disclosure. Regardless of the location of the individual fracture points, fluid is pumped from the first topside facility 110 and the second topside facility 112 simultaneously to the fracturing point of choice. Pressure is regulated separately at the first topside facility 110 and the second topside facility 112 so that pressure of the fracturing fluid 114 from both facilities is at substantially the same pressure at the fracture point of choice. In some implementations, though regulated separately, the pressure at both the first topside facility 110 and the second topside facility 112 can be coordinated. For example, fluid can be pumped from the first topside facility 110 at a first specified pressure simultaneously as fluid is pumped from the second topside facility 112 at a second specified pressure. Both facilities can be aware of the operations occurring at one-another and can adjust operations to coordinate with one another in the event of an unexpected occurrence. In some implementations, the first fracture point 316*a*, the second fracture point 316*b*, the third fracture point 316*c*, and the fourth fracture point 316*d* are fractured serially. That is, each fracture point is fractured one at a time. In some implementations, multiple fracture points can be fractured simultaneously.

Figure 4:
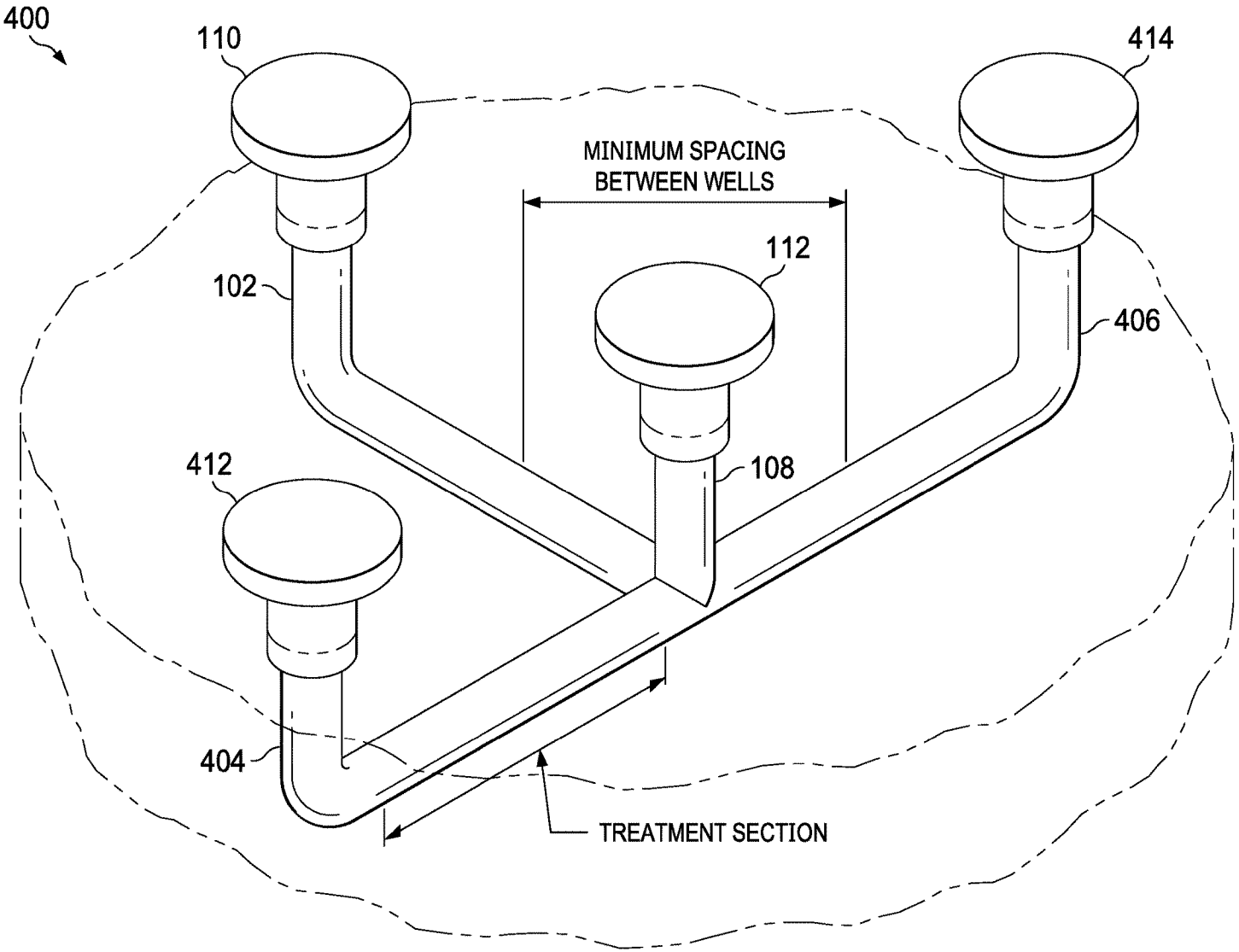
FIG. 4 is a schematic diagram of a production field with multiple U-shaped wellbores sharing a common central vertical wellbore.

FIG. 4 is a schematic diagram of a production field 400 with multiple U-shaped wellbores sharing a common central vertical wellbore, such as vertical wellbore 108. In such implementations, multiple horizontal wellbores, such as the first horizontal wellbore 102, a second horizontal wellbore 404, and a third horizontal wellbore 406 each have a respective vertical section and a respective horizontal section. The vertical wellbore 108 is drilled to intersect with the toe of the first horizontal wellbore 102, the second horizontal wellbore 404, and the third horizontal wellbore 406. Such an arrangement results in a hub-and-spoke arrangement. Fracturing fluid can be pumped from the topside facility 112 into any of the horizontal sections. Each of the additional wellbores has an additional topside facility. For example, a third topside facility 412 is located at the top of the third wellbore 404 and a fourth topside facility 414 is located at the top of the fourth wellbore 406. During fracturing operations, fracturing fluid is pumped from the topside facility 112 and the respective topside facility for a particular horizontal section simultaneously. Multiple fracture points can exist in each horizontal section. Alternatively or in addition, fracture points can be present in any of the vertical wellbore sections. While illustrated with three horizontal wellbores and one vertical wellbore, greater or fewer wellbores can be used. After fracturing operations, the vertical wellbore can be used to produce from or monitor the various horizontal wellbore sections. In some implementations, the fracturing points in the various wellbores can be notched prior to fracturing operations.

Figure 5:
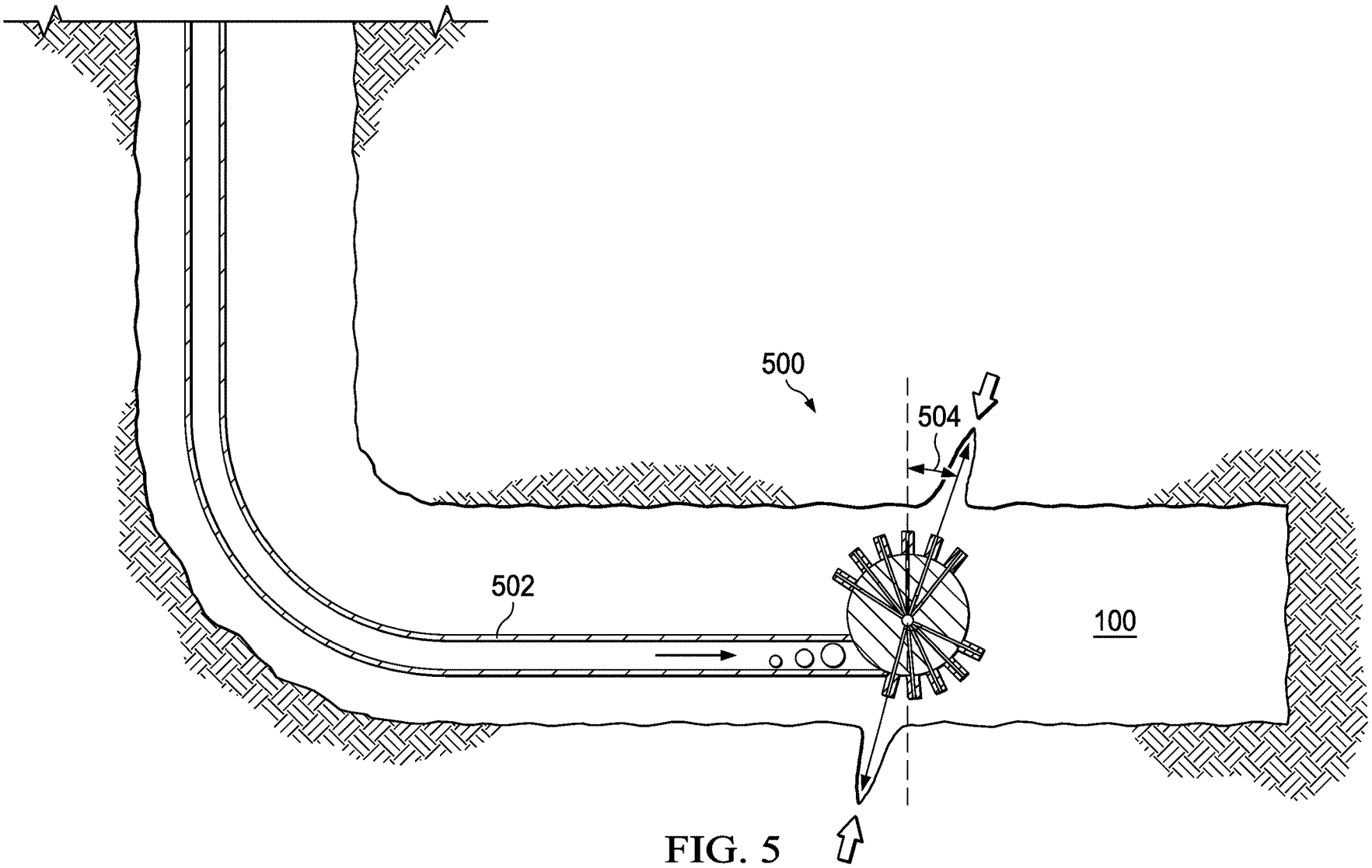
FIG. 5 is a schematic diagram of an example notching tool positioned within the U-shaped wellbore.

As previously described, any of the fracturing points can be notched prior to fracturing. FIG. 5 is a schematic diagram of an example hydraulic notching tool 500 positioned within a U-shaped wellbore, such as U-shaped wellbore 100. The hydraulic notching tool is positioned within the wellbore 100 by a length of coiled tubing 502 extending from a topside facility. The hydraulic notching tool 500 is supplied with hydraulic notching fluid from the topside facility. The hydraulic notching fluid need not be the same as the fracturing fluid. For example, the hydraulic notching fluid can include an abrasive suspended within the hydraulic notching fluid while the fracturing fluid can include proppant suspended in the fracturing fluid. In some implementations, the hydraulic notching fluid is the same as the fracturing fluid. Fluid selection for both fracturing and notching is determined one a case-by-case basis for each individual well based on rock properties, reservoir pressures, and other factors. The hydraulic tool 500 is configured to spray the notching fluid at sufficient pressure to create a notch in the wellbore 100. The pressure required is dependent upon the rock properties at the fracture point. In some implementations, the notch includes a point, corner, or other discontinuity that can create a stress concentration factor. The hydraulic notching tool 500 is configurable in-hole to notch at a specified angle 504. That is, the notching angle 504 can be adjusted after the hydraulic notching tool 500 is at the fracture point. In some implementations, the notching angle 504 is substantially perpendicular (+/−5°) to the least principal stress of the wellbore section to be notched.

Figure 6A:
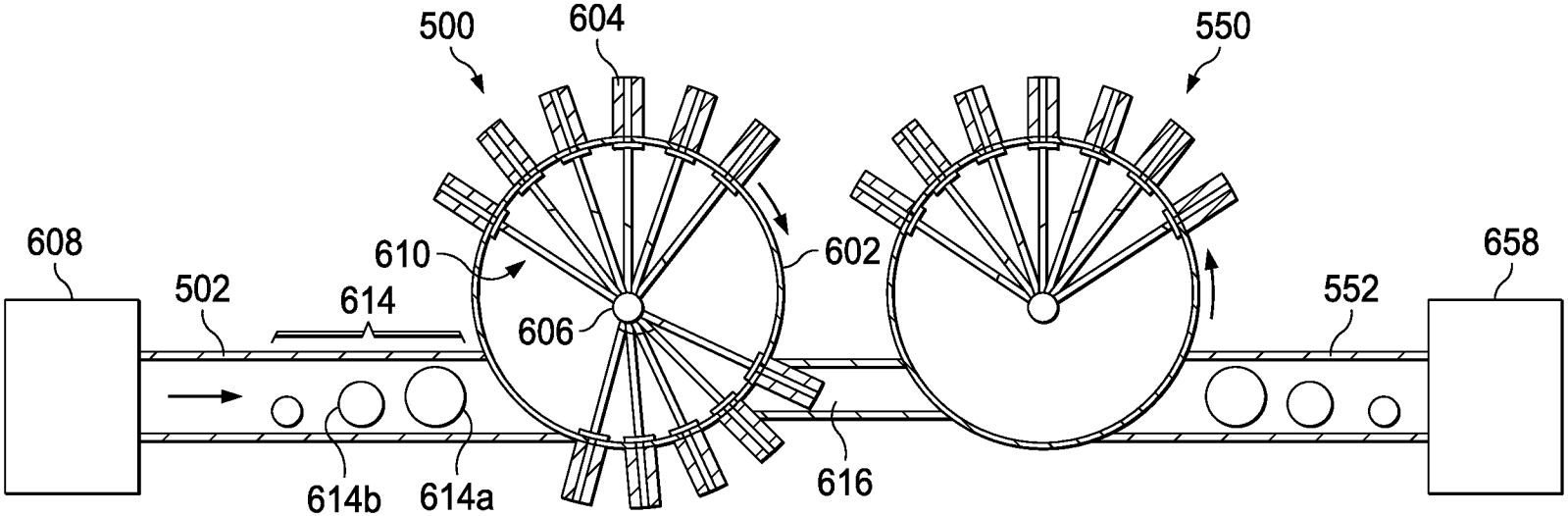
FIGS. 6A-6C are schematic diagrams of the notching tool.
Figure 6C:
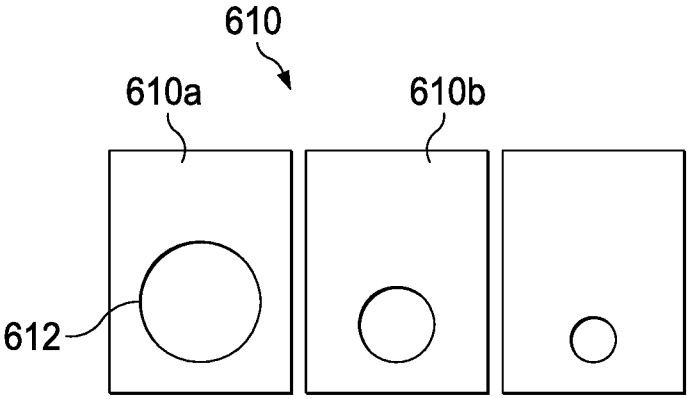
Figure 6B:
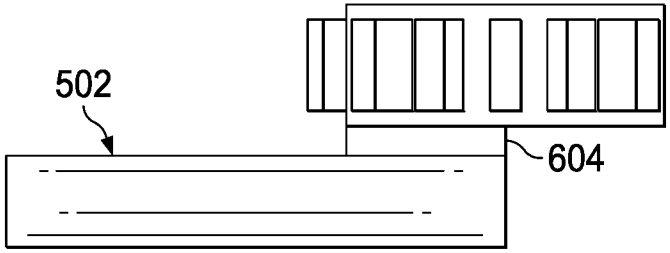

FIGS. 6A-6C are schematic diagrams of the hydraulic notching tool 500 and various components. The hydraulic notching tool 500 includes a cylindrical drum 602 with a fluid nozzle 604 along an outer surface of the cylindrical drum 602. The fluid nozzle 604 is configured to be connected to a downhole end of a fluid conduit, such as the coiled tubing 502. The hydraulic notching tool includes multiple actuable fluid nozzles 604 fluidically connected to an interior of the cylindrical drum 602 and positioned around the outer circumference of the cylindrical drum 602. The fluid nozzles 604 are positioned to direct fluid away from the cylindrical drum 602 and towards a wall of the wellbore 100. A rotatable collar 606 is positioned in the center of the cylindrical drum 602. The rotatable collar 606 has an outer surface parallel to the inner surface of the cylindrical drum 602. In some implementations, an isolation packer 608 positioned uphole of the hydraulic notching tool 500. The isolation packer 608 fluidically isolates a section of the wellbore 100 to be notched from a remainder of the wellbore 100.

Multiple sleeve plates 610, one for every fluid nozzle 604, are positioned between the inner surface of the cylindrical drum 602 and the outer surface of the rotatable collar 606. Each of the sleeve plates 610 defines a hole 612 with a diameter smaller than a diameter of a corresponding dropped ball 614. For example, a first sleeve plate 610*a* has a first hole with a first diameter smaller than a first dropped ball 614*a* of a first size. A second sleeve plate 610*b* has a second hole with a second diameter smaller than a second dropped ball 614*b* of a second size. Each of the sleeve plates 610 are configured to rotate around the rotatable collar 606 when a dropped ball 614 corresponding to one of the sleeve plates 610 is received. Each rotated sleeve plate is configured to direct fluid towards a respective nozzle in response to the rotation. In some implementations, the dropped ball 614 is a dissolvable dropped ball. The dissolvable dropped ball is configured to dissolve at a specified time within a notching fluid. In some implementations, notching fluid flow from the topside facility is timed to correspond with the desired fracture formation.

As previously mentioned, the wellbore can be a U-shaped wellbore, such as the U-shaped wellbore 100, with a topside facility at each end, such as the first topside facility 110 and the second topside facility 112 (FIG. 1). The fluid conduit (coiled tubing 502) can be a first fluid conduit extending from the first topside facility 110. The hydraulic notching tool 500 can be a first hydraulic notching tool 500 and the isolation packer 608 can be a first isolation packer 608. A second fluid conduit 552 can extend from the second topside facility 112. In some implementations, a second well-notching tool 550, identical or similar to the first hydraulic notching tool 500, is fluidically connected to a downhole end of the second fluid conduit 552 within the U-shaped wellbore. A second isolation packer 658 is positioned uphole of the second well-notching tool 550. The second isolation packer 658 fluidically isolates the section of the wellbore 100 to be notched from a remainder of the wellbore 100 toward the second topside facility 122.

In such an implementation, notching fluid can be pumped from both the first topside facility 110 and the second topside facility 112 simultaneously for notching operations. In some implementations, the first fluid notching tool 500 and the second notching tool 550 can be fluidically coupled to one another by a fluid conduit 616. The fluid conduit 616 can be used to equalize pressure between the first fluid notching tool 500 and the second hydraulic notching tool 550. By utilizing pressure from both topside facilities, higher nozzle pressures can be achieved by the first hydraulic notching tool 500 and the second hydraulic notching tool 550. In some implementations, the first fluid notching tool 500 and the second fluid notching tool 550 are substantially similar. For example, the first fluid notching tool and the second fluid notching tool can include a similar outer housing. In some implementations, while the outer housing can be similar, the second fluid notching tool 550 can have a different number of fluid nozzles or fluid nozzles at different angles than the first fluid notching tool 500.

Figure 6D:
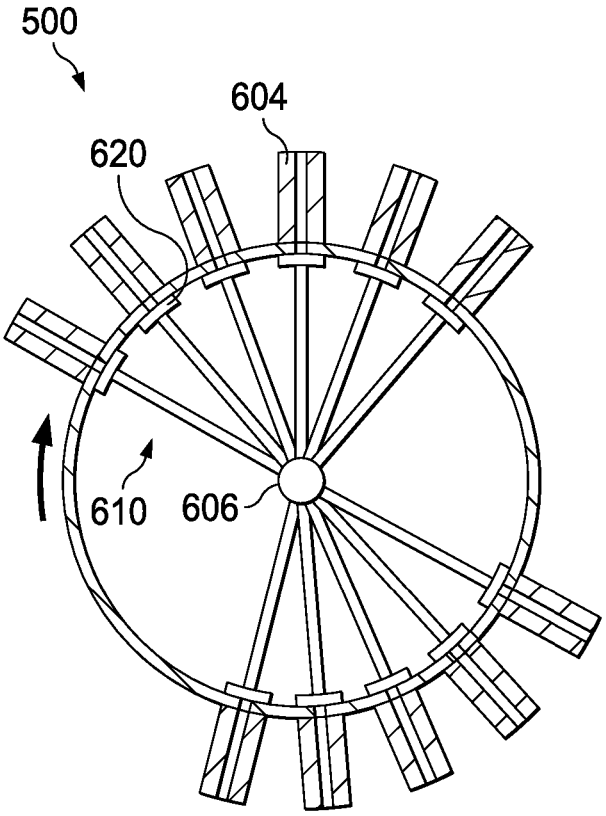
FIGS. 6D-6E are schematic diagrams of the notching tool drum in various stages of operation.
Figure 6E:
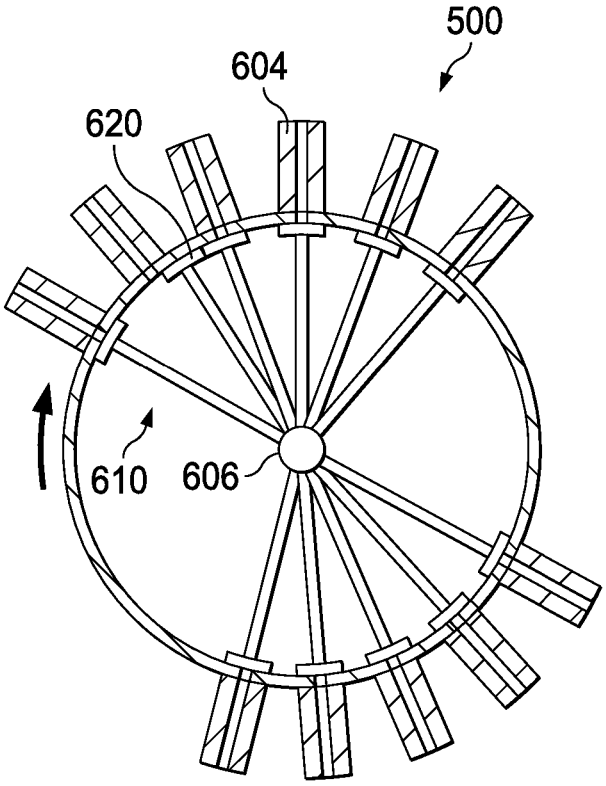

FIGS. 6D-6E are schematic diagrams of the notching tool drum in various stages of operation. Each of the sleeve plates 610 are configured to rotate around the rotatable collar 606 when a dropped ball 614 is received. Each rotated sleeve of the sleeve plates are configured to direct fluid towards a respective nozzle in response to the rotation. For example, as shown in FIG. 6D, the sleeve plates 610 are in a first position. Each sleeve plate is coupled to a gate 620 across each of the corresponding nozzles 604. In the first position, each of the sleeve plates 610 holds their respective gates 620 in a closed position. FIG. 6E shows a gate 620 in an open position. The gate 620 is moved to an open position once the corresponding sleeve plate 610 has received a ball corresponding to that sleeve plate 610. The pressure build-up caused by the ball 614 being seated on the respective sleeve plate 610 causes the sleeve plate 610 and the corresponding gate 620 to move.

Figure 7:
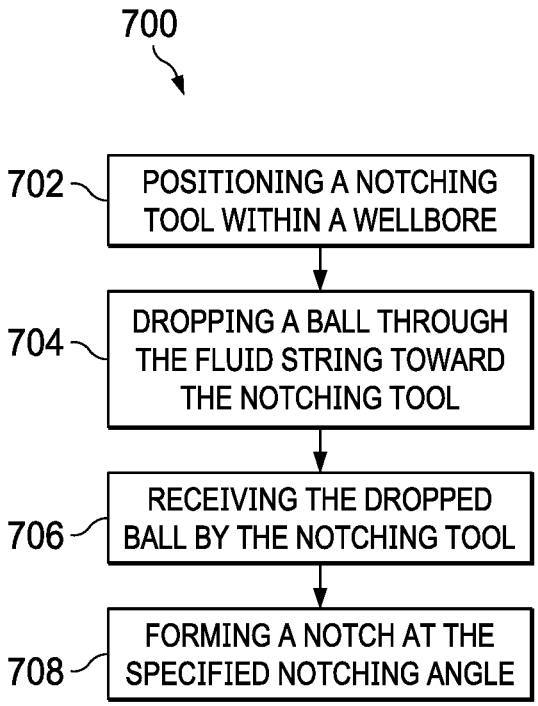
FIG. 7 is a flowchart of an example method that can be used with aspects of this disclosure.

FIG. 7 is a flowchart of an example method 700 for notching a wellbore that can be used with aspects of this disclosure. At 702, a notching tool, such as the notching tool 500, is positioned within a wellbore at a distal (downhole) end of a fluid string, such as the coiled tubing 502. At 704, a ball is dropped through the fluid string toward the notching tool. The dropped ball is sized to trigger a specified notching angle. In some implementations, prior to notching the wellbore, a log of the wellbore is taken to determine an angle of the least principle stress within the wellbore. In some implementations, the specified notching angle is substantially perpendicular (+/−5°) to the least principal stress of the wellbore. At 706, the dropped ball is received by the notching tool. In some implementations, receiving the dropped ball by the notching tool includes receiving the dropped ball by a sleeve plate within the notching tool. The sleeve plate receiving the dropped ball has a hole with a smaller diameter than the received dropped ball. At 708, a notch is formed at the specified notching angle. Forming the notch can include actuating the sleeve plate in response to receiving the dropped ball, and directing fluid through a nozzle that corresponds to the actuated sleeve plate. In some implementations, the dropped ball is a dissolvable dropped ball configured to dissolve after a pre-determined amount of time. In some implementations, the amount of time to notch is controlled by ceasing the flow of notching fluid from the topside facility at a specified time. The amount of time required to create the notch is dependent on pressures and flow rates of the notching fluid, and rock properties at the fracture point.

After the notch has been formed, the hydraulic notching tool is removed from the wellbore. Fracturing fluid can be pumped through the wellbore toward the notch once the hydraulic notching tool has been removed. In some implementations, the hydraulic tool can make multiple notches before being removed from the wellbore. In some implementations, multiple hydraulic notching tools can be used within a single wellbore simultaneously.

Figure 8:
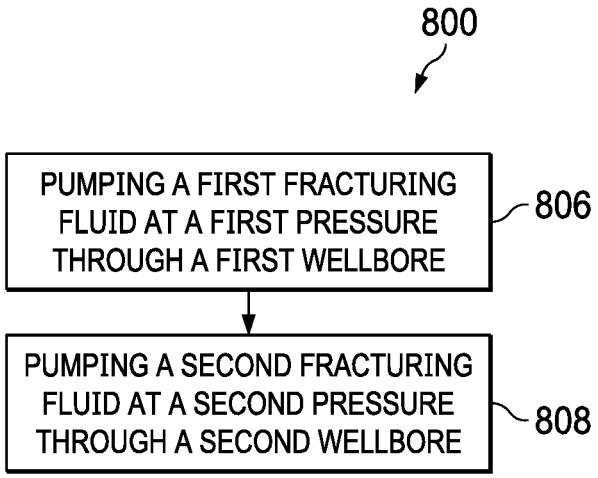
FIG. 8 is a flowchart of an example method that can be used with aspects of this disclosure.

FIG. 8 is a flowchart of an example method 800 that can be used with aspects of this disclosure. A first wellbore with a first vertical section and horizontal section having a first end, intersecting from the first vertical section, and a distal end, is drilled. A second wellbore having a second vertical section that intersects with the distal end of the horizontal section is drilled. At 806, a first fracturing fluid is pumped at a first pressure through a first wellbore with a vertical section and a horizontal section having a first end, intersecting from the vertical section, and a distal end. At 808, a second fracturing fluid is pumped at a second pressure through a second wellbore that intersects with the distal end of the horizontal section. Pumping the second fracturing fluid occurs simultaneously as pumping the first fracturing fluid. In some implementations, the fracture point is halfway through a length of the horizontal section. In some implementations, the first fracturing fluid and the second fracturing fluid are substantially identical.

In some instances, the first pressure is different from the second pressure. In general, the first pressure and the second pressure result in the first fracturing fluid and the second fracturing fluid intersecting at a fracture point within the horizontal section at a third pressure. The first fracturing fluid and the second fracturing fluid experience a first pressure drop and a second pressure drop, respectively, while traveling through their respective wellbores to the fracture point. Such a difference in pressure drop can occur when the fracture point is closer to one topside facility than the other. In some implementations, a third wellbore with a second vertical section and a second horizontal section intersects with the second wellbore. In such implementations, a third fracturing fluid can be pumped through the third wellbore. In such an implementation, the second fracturing fluid is pumped through the second wellbore while simultaneously pumping the third fracturing fluid.

In some implementations, regardless of where the fracture point is located, the fracture point can be notched prior to pumping fracturing fluid through the first wellbore or the second wellbore, for example, using method 700. While previously described as notching with a hydraulic notching tool, other notching tools can be used without departing from this disclosure. In some implementations, such a notch can be substantially perpendicular (+/−5°) to the least principal stress of the horizontal section.

While this disclosure contains many specific implementation details, these should not be construed as limitations on the scope of what may be claimed, but rather as descriptions of features specific to particular implementations. Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the implementations previously described should not be understood as requiring such separation in all implementations, and it should be understood that the described components and systems can generally be integrated together in a single product or packaged into multiple products. For example, the hydraulic notching tools described herein can be applied to other, non-U-shaped wellbores. Alternatively or in addition, other notching tools can be used in a U-shaped wellbore to achieve similar results prior to fracturing. For example, other hydraulic tool configurations can be used, laser notching tools can be used, or mechanical notching tools can be used with similar results.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

What is claimed is:

1. A method of notching a wellbore comprising:

positioning a notching tool within a wellbore at a distal end of a fluid string, wherein the notching tool is configurable in-hole to notch at a notching angle, and the notching angle of the notching tool is adjustable after the notching tool is at a fracture point within the wellbore;

adjusting the notching angle by dropping a ball through the fluid string toward the notching tool, the dropped ball sized to trigger a specified notching angle;

receiving the dropped ball by the notching tool; and forming a notch at the specified notching angle.

2. The method of claim 1, further comprising determining an angle of the least principle stress within the wellbore.

3. The method of claim 1, wherein the specified notching angle is perpendicular to the least principle stress of the wellbore.

4. The method of claim 1, wherein the tool comprises a plurality of sleeve plates and wherein receiving the dropped ball by the notching tool comprises receiving the dropped ball by a first sleeve plate of the plurality of sleeve plates, the first sleeve plate having a hole with a smaller diameter than the received dropped ball.

5. The method of claim 4, wherein the dropped ball is a dissolvable dropped ball configured to dissolve after a pre-determined period of time.

6. The method of claim 4, wherein forming the notch comprises:

actuating the first sleeve plate in response to receiving the dropped ball; and directing fluid through a nozzle that corresponds to the first sleeve plate.

7. The method of claim 1, further comprising:

removing the notching tool from the wellbore; and pumping a fracturing fluid through the wellbore toward the notch.

8. The method of claim 7, wherein the wellbore is a U-shaped wellbore with a first end, a second end, and a horizontal wellbore section.

9. The method of claim 8, wherein pumping the fracturing fluid comprises:

pumping fracturing fluid from a first end of the wellbore; and pumping fracturing fluid from a second end of the wellbore.

* * * * *